US007661993B2

(12) United States Patent
Liu

(10) Patent No.: US 7,661,993 B2
(45) Date of Patent: Feb. 16, 2010

(54) ELECTRONIC DEVICE AND RECEPTACLE CONNECTOR THEREOF

(75) Inventor: Sheng-Ming Liu, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 12/265,236

(22) Filed: Nov. 5, 2008

(65) Prior Publication Data

US 2009/0311911 A1 Dec. 17, 2009

(30) Foreign Application Priority Data

Jun. 16, 2008 (TW) ..... 97210623 U

(51) Int. Cl.
*H01R 24/00* (2006.01)

(52) U.S. Cl. ..... 439/660; 439/677

(58) Field of Classification Search ..... 439/660, 439/677, 650–652

See application file for complete search history.

(56) References Cited

U.S. PATENT DOCUMENTS 6,280,251 B1 8/2001 Nishio et al.
6,755,693 B2 * 6/2004 Nishio et al. ..... 439/660
7,128,608 B1 10/2006 Chen
2008/0096412 A1 4/2008 Poh et al.
2009/0130873 A1 * 5/2009 He ..... 439/108
2009/0149078 A1 * 6/2009 Kondo et al. ..... 439/660

FOREIGN PATENT DOCUMENTS

EP 0 994 533 A1 4/2000
EP 1 860 746 A2 11/2007

* cited by examiner

*Primary Examiner*—Michael C Zarroli
(74) *Attorney, Agent, or Firm*—Birch, Stewart, Kolasch & Birch, LLP

(57) ABSTRACT

A receptacle connector is provided for connection with a plug having two hooks. The receptacle connector includes a first tongue segment, a second tongue segment, and a housing forming an opening and two holes. The first and second tongue segments are disposed in the housing and opposite to each other. The first tongue segment includes a main body, a plurality of first contacts and two stoppers, wherein the two stoppers are located at opposite sides of the contacts and fixed to the main body. When the plug is inserted into the housing through the opening with a normal posture, the hooks are engaged in the holes. When the plug is wrongly inserted into the housing with an inverted posture (upside down), the stoppers obstruct the hooks to prevent insertion of the plug.

10 Claims, 6 Drawing Sheets

ELECTRONIC DEVICE AND RECEPTACLE CONNECTOR THEREOF

CROSS REFERENCE TO RELATED APPLICATIONS

This Application claims priority of Taiwan Patent Application No. 97210623, filed on Jun. 16, 2008, the entirety of which is incorporated by reference herein.

TECHNICAL FIELD

The application relates in general to a receptacle connector and in particular to a receptacle connector preventing improper insertion of a plug.

DESCRIPTION OF THE RELATED ART

The Universal Serial Bus Implementers Forum (USB IF) has designed a new standard called Micro USB, to replace the Mini USB standard which has been applied to many portable electronic devices. The Micro USSB connector has a smaller size and better functionality than Mini USSB connector.

Referring to FIGS. 1A and 1B, a conventional AB-type Micro USB receptacle connector 10 includes an opening 11 and a tongue segment 12 disposed on an upper side of the opening 11. The tongue segment 12 includes a plurality of contacts 121 (such as the five contacts 121 shown in FIG. 1B) for connection with a plug (not shown). When the plug is inserted into the receptacle connector 10 upside down, the tongue segment 12 can be damaged. With compact size and weak strength of the Micro USB receptacle connector 10, a robust mechanism is required to prevent improper insertion of the plug.

BRIEF SUMMARY

The present application provides a receptacle connector for connection with a plug which has two hooks. The receptacle connector includes a first tongue segment, a second tongue segment, and a housing having an opening and two holes. The first and second tongue segments are disposed in the housing and opposite to each other. The first tongue segment includes a main body, a plurality of first contacts and two stoppers, wherein the two stoppers are located at opposite sides of the contacts and fixed to the main body. When the plug is inserted into the housing through the opening with a normal posture, the hooks are engaged in the holes. When the plug is wrongly inserted into the housing with an inverted posture (upside down), the stoppers obstruct the hooks to prevent insertion of the plug.

BRIEF DESCRIPTION OF DRAWINGS

The application can be more fully understood by reading the subsequent detailed description and examples with references made to the accompanying drawings, wherein.

DETAILED DESCRIPTION

Figure 1A:
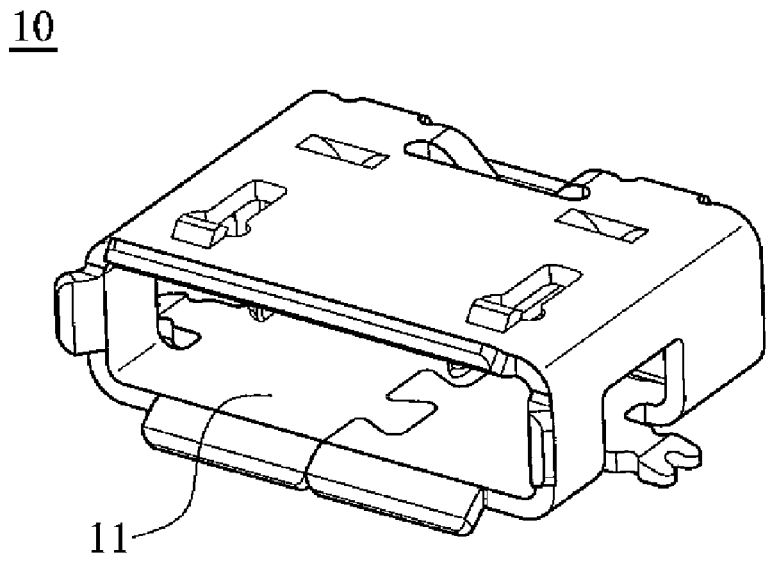
FIG. 1A ( PRIOR ART )
FIGS. 1A and 1B are perspective diagrams of a conventional Micro USB receptacle connector.
Figure 1B:
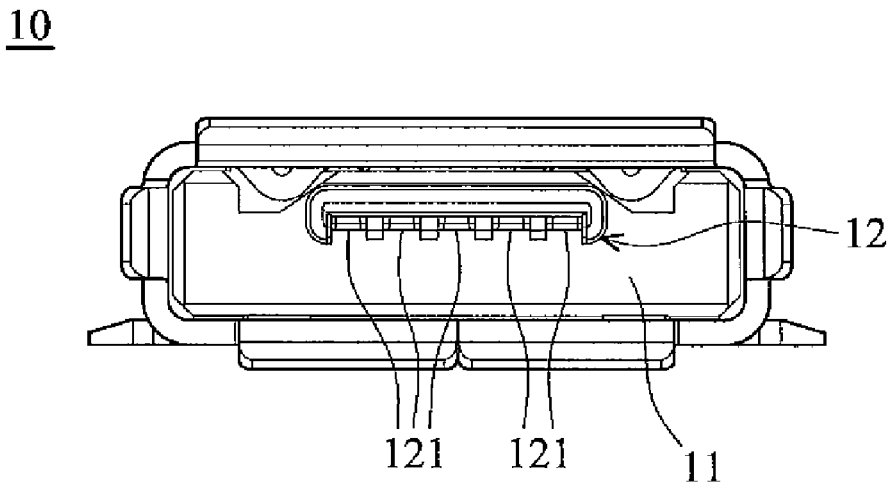
FIG. 1B ( PRIOR ART )
Figure 2A:
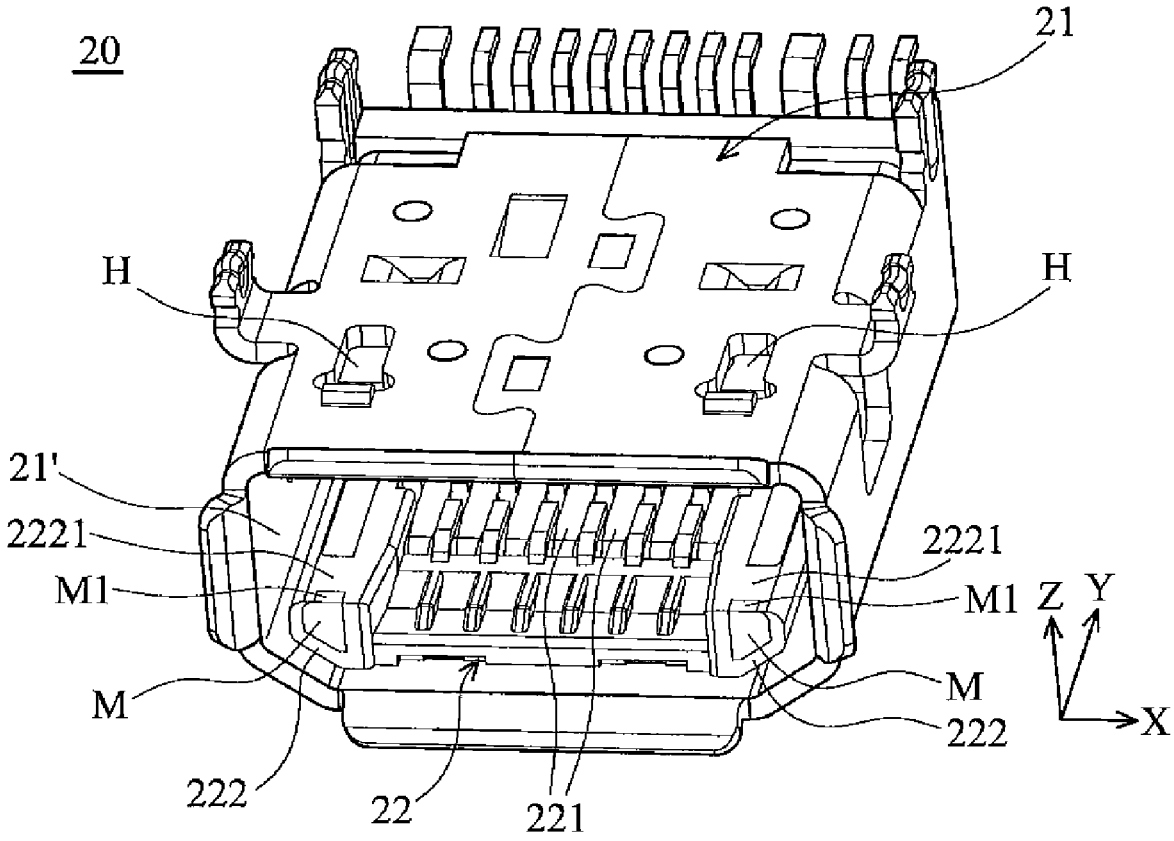
FIGS. 2A and 2B are perspective diagrams of a receptacle connector according to an embodiment of the application.
Figure 2B:
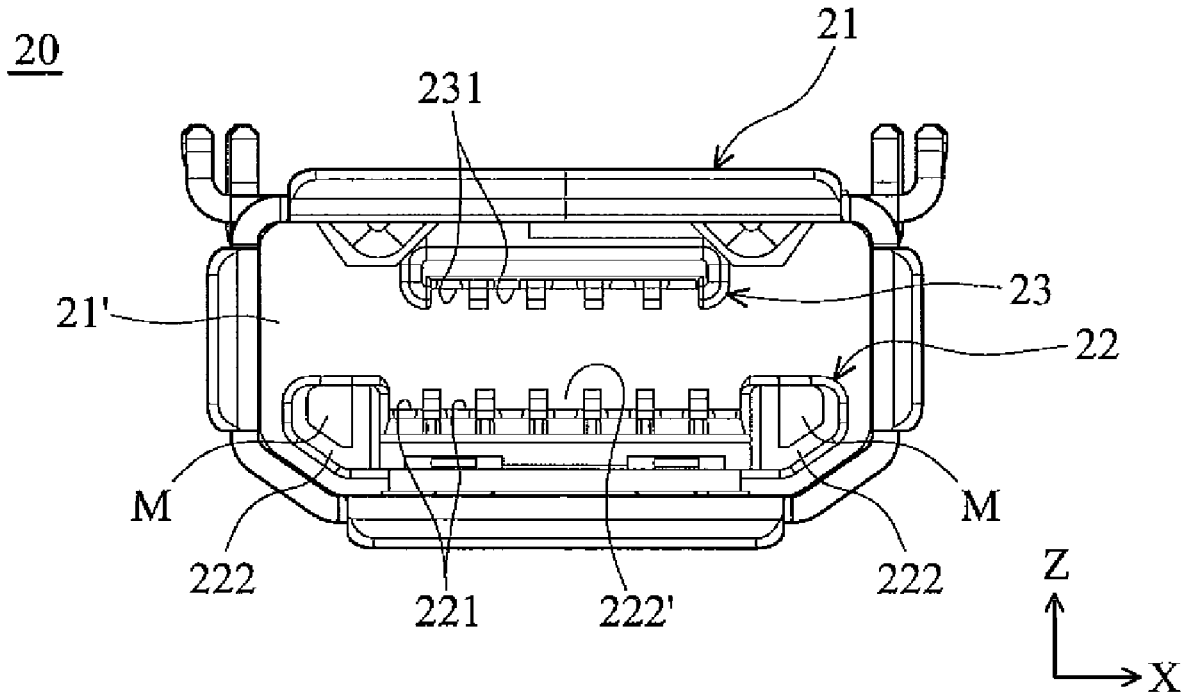

Referring to FIGS. 2A and 2B, an embodiment of a receptacle connector 20 is provided, such as a Micro USB receptacle connector, and is applied to a mobile phone, PDA, Ultra-Mobile PC (UMPC), portable electronic device or handheld electronic device. The receptacle connector 20 includes a housing 21 forming an opening 21'. As shown in FIGS. 2A and 2B, a first tongue segment 22 and a second tongue segment 23 are disposed within opening 21', respectively.

Figure 3A:
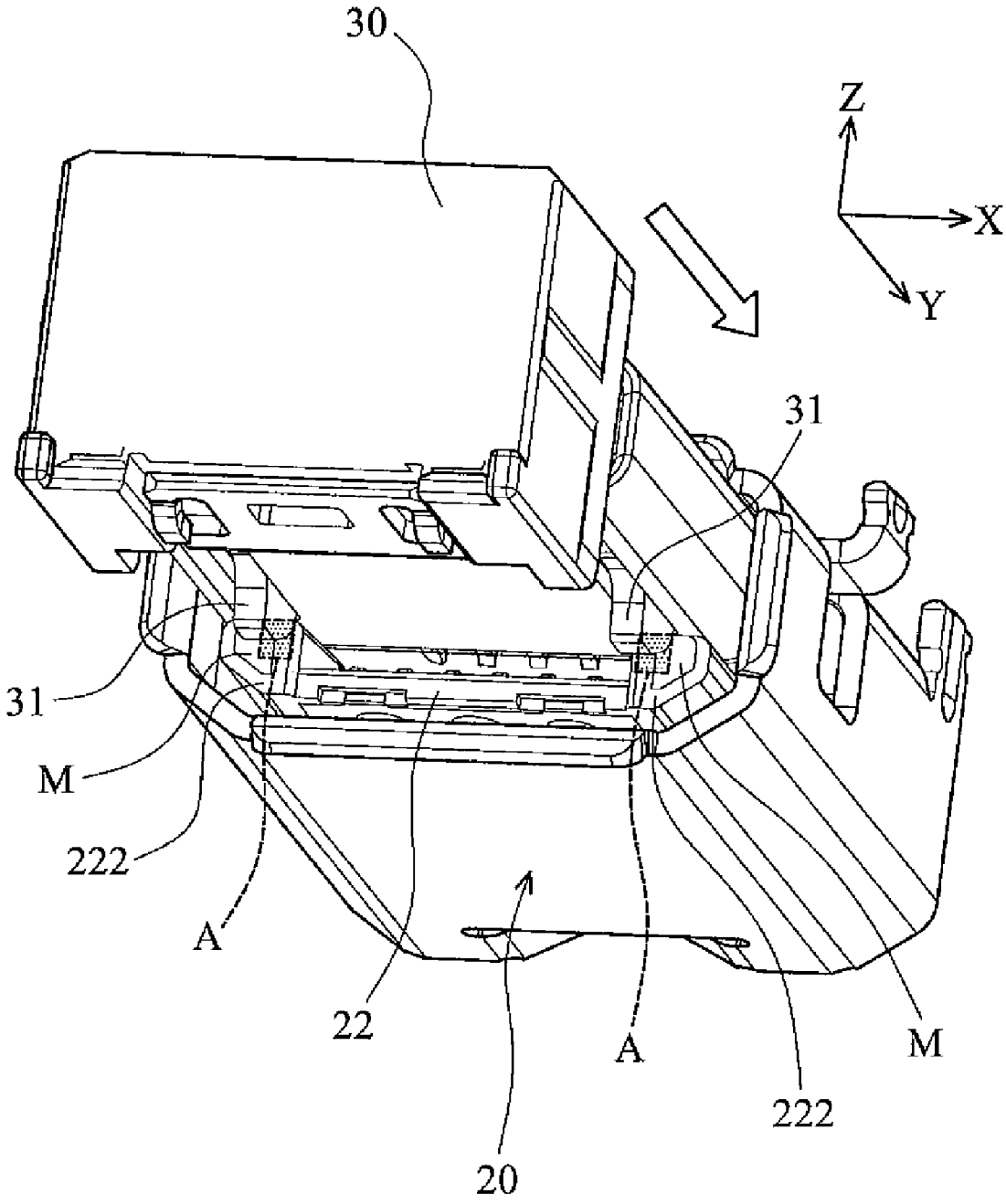
FIGS. 3A~3C are perspective diagrams of a plug inserted into a receptacle connector upside down.
Figure 3B:
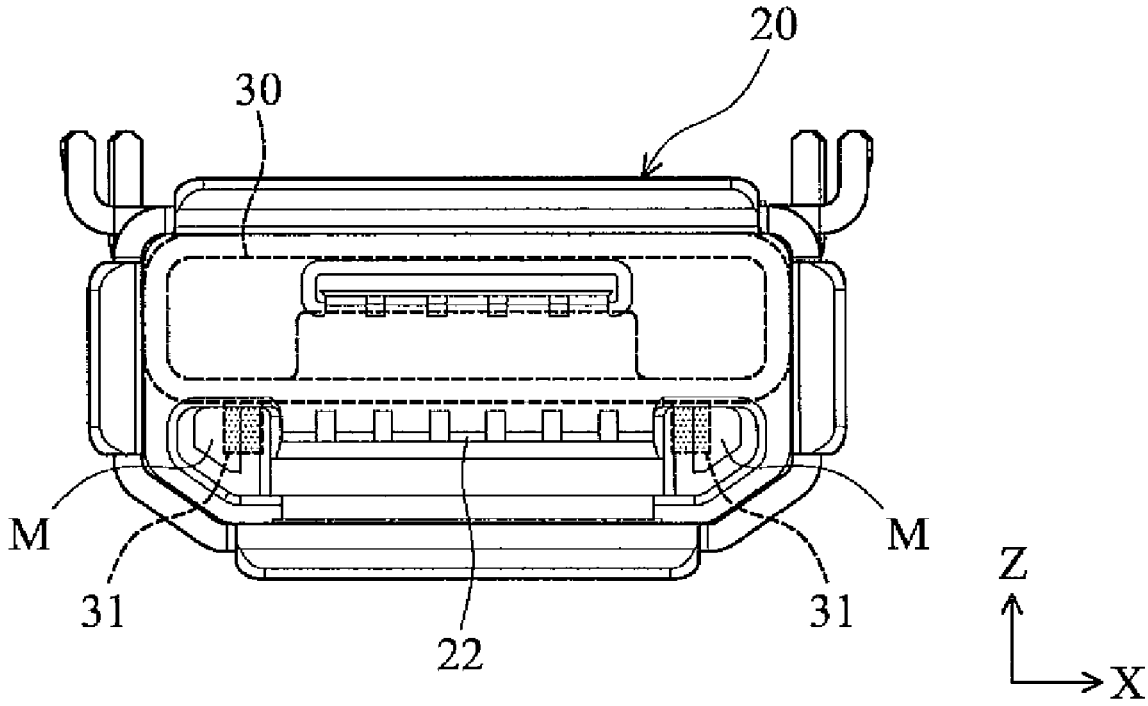

In this embodiment, the first tongue segment 22 includes 7 first contacts 221, and the second tongue segment 23 includes 5 second contacts 231 for electrical connection with a plug 30 shown in FIGS. 3A and 3B. When the plug 30 is joined into the receptacle connector 20 through the opening 21' with a normal posture, two hooks 31 of the plug 30 are respectively engaged with two holes H of the housing 21. In other embodiments, the plug 30 may be an A-type or B-type plug which has 5 or 12 contacts.

In FIGS. 2A and 2B, the first tongue segment 22 further includes a main body 222 and two stoppers M. The first contacts 221 are disposed in a recess 222' in the middle of the main body 222. In particular, the two stoppers M are disposed at opposite sides of the recess 222' and embedded in the main body 222, thereby enhancing structural strength of the first tongue segment 22 and preventing damages of the first and second tongue segments 22 and 23 due to improper insertion of the plug 30.

Figure 3C:
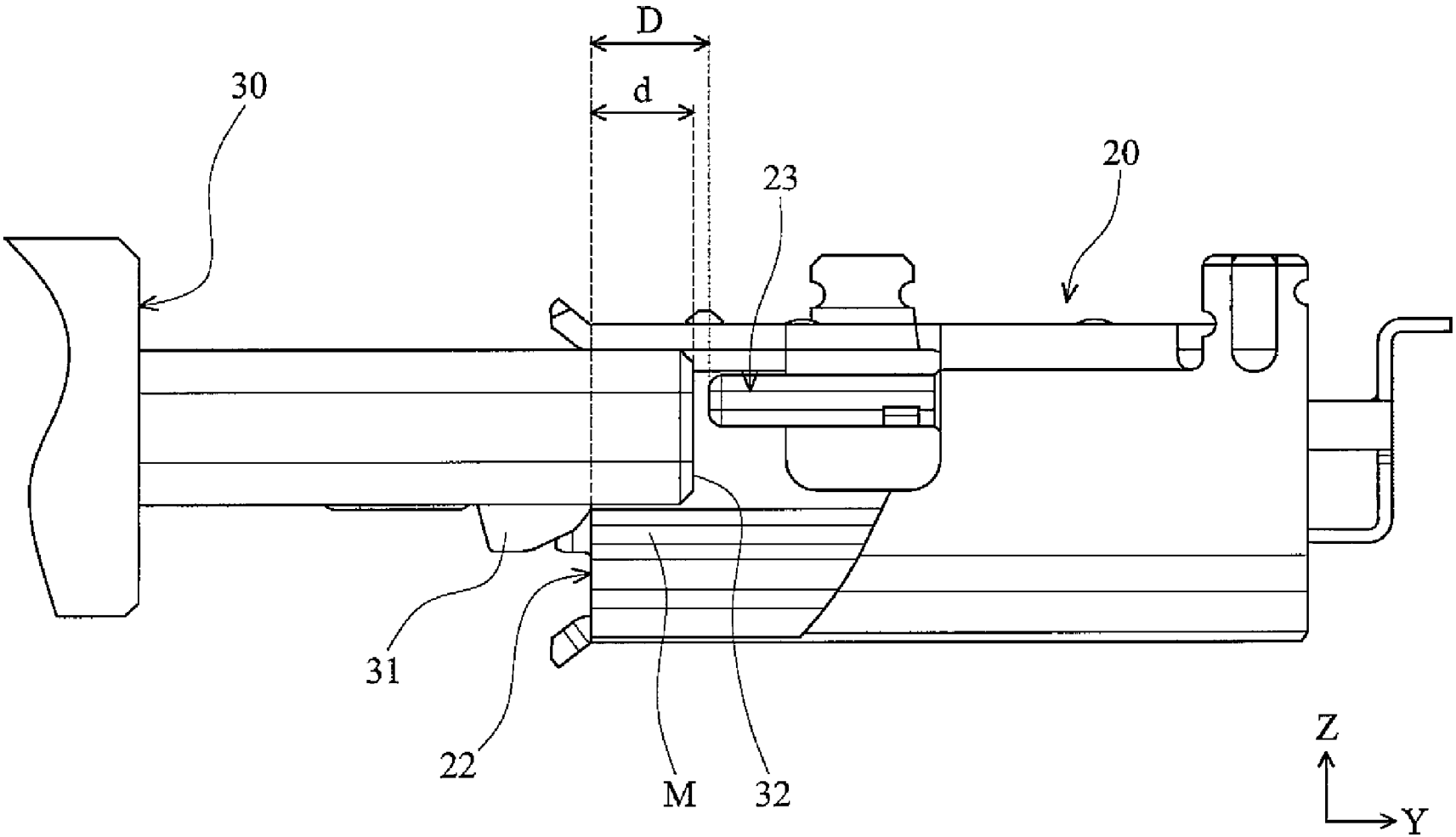

Referring to FIGS. 3A and 3B, when the plug 30 is wrongly inserted into the receptacle connector 20 with an inverted posture (upside down), the hooks 31 are obstructed and stopped by the stoppers M of the first tongue segment 22, as the projection area A shows in FIGS. 3A and 3B. Hence, improper insertion of the plug 30 is prohibited by mechanical interference between the hooks 31 and the stoppers M, so as to prevent damage of the first and second tongue segments 22 and 23. As shown in FIG. 3C, the first tongue segment 22 protrudes from the second tongue segment 23 at a distance D along the Y axis, and the hook 3 land an end 32 of the plug 30 have a distance d along the Y axis. Since D>d, the plug 30 is prevented from impacting the second tongue segment 23 when inserted into the receptacle connector 20 upside down.

The main body 222 can be plastic, and the stoppers M may can be metal or other rigid material, wherein hardness value of the stoppers M exceeds that of the main body 222. As shown in FIG. 2A, each of the stoppers M has a surface M1 facing to the holes H and is exposed by a side 2221 of the main body 222. In other embodiments, the surface M1 may be concealed by the main body 222 and not exposed by the side 2221 of the main body 222.

In this embodiment, the first tongue segment 22 includes 7 first contacts, and the second tongue segment 23 includes 5 second contacts for electrical connection with a plug 30 which has 5 or 12 contacts. However, the first tongue segment 22 may have 6 or any number of contacts. No matter what the plug 30 is A-type or B-type with 5 or more contacts plug, improper insertion of the plug 30 into the receptacle connector 20 can be efficiently prohibited by interference between the hooks 31 and the stoppers M.

The present application provides a receptacle connector including two stoppers disposed at opposite sides of a tongue segment, so as to obstruct a plug and prevent improper insertion thereof into the receptacle connector. Since hardness value of the stoppers exceeds that of conventional plastic tongue segment, damage of the receptacle connector due to improper insertion of the plug is prevented.

While the invention has been described by way of example and in terms of embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A receptacle connector for connection with a plug having two hooks, comprising:

a housing, having an opening and two holes;

a first tongue segment disposed in the housing, comprising a main body, a plurality of first contacts, and two stoppers, wherein the two stoppers are fixed to the main body and located at opposite sides of the contacts; and a second tongue segment disposed in the housing and opposite to the first tongue segment, wherein when the plug is inserted into the housing through the opening with a normal posture, the hooks are engaged in the holes, and when the plug is inserted into the housing with an inverted posture, opposite to the normal posture, the stoppers obstruct the hooks to prevent insertion of the plug.

2. The receptacle connector as claimed in claim 1, wherein hardness of the stoppers exceeds that of the main body.

3. The receptacle connector as claimed in claim 1, wherein the stoppers comprise metal.

4. The receptacle connector as claimed in claim 1, wherein each of the stoppers has a surface facing to the holes and the surface is exposed by the main body.

5. The receptacle connector as claimed in claim 1, wherein each of the stoppers has a surface facing to the holes and is concealed by the main body.

6. The receptacle connector as claimed in claim 1, wherein the main body comprises a recess with the first contacts disposed therein, and the stoppers are located at opposite sides of the recess.

7. The receptacle connector as claimed in claim 1, wherein an end of each stopper is exposed by the main body and the ends are toward the opening.

8. The receptacle connector as claimed in claim 1, wherein the first tongue segment protrudes from the second tongue segment at a first distance along a first axis, and the hooks and an end of the plug have a second distance along the first axis, wherein the first distance exceeds the second distance.

9. The receptacle connector as claimed in claim 1, wherein the first tongue segment has 7 first contacts, and the second tongue segment has 5 second contacts.

10. An electronic device, including the receptacle connector as claimed in claim 1.

* * * * *